US006601262B2

(12) United States Patent
Janssen

(10) Patent No.: US 6,601,262 B2
(45) Date of Patent: Aug. 5, 2003

(54) PAINT SYSTEM

(75) Inventor: Robert Ives Janssen, Mendota Heights, MN (US)

(73) Assignee: Padco, INC

( * ) Notice: Subject to any disclaimer, the term of this patent is extended or adjusted under 35 U.S.C. 154(b) by 0 days.

(21) Appl. No.: 09/829,542

(22) Filed: Apr. 10, 2001

(65) Prior Publication Data

US 2001/0022993 A1 Sep. 20, 2001

Related U.S. Application Data

(62) Division of application No. 09/258,219, filed on Feb. 26, 1999, now Pat. No. 6,238,740.

(60) Provisional application No. 60/096,423, filed on Aug. 13, 1998.

(51) Int. Cl.[7] ..... B05C 17/00; B05C 1/08; B44D 3/12

(52) U.S. Cl. ..... 15/230.11; 15/257.05; 15/257.06; 15/210.1; 206/229; 492/13; 492/19; 118/216; 118/255; D4/122; D4/123; D32/53.1

(58) Field of Search ..... 15/257.05, 257.06, 15/210.1, 230.11, 210.5; 118/255, 264, 216; 492/13, 19; 206/229; 401/119, 130; D4/122, 123; D32/53.1

(56) References Cited

U.S. PATENT DOCUMENTS 1,689,855 A * 10/1928 Breitenbach ..... 15/166
2,838,781 A * 6/1958 Molle
3,648,322 A * 3/1972 Meisner
4,107,815 A * 8/1978 Dumesnil, Jr. ..... 15/257.05
4,164,803 A * 8/1979 Zurawin et al. ..... 15/257.05
4,528,712 A * 7/1985 Leibow ..... 15/118
4,941,229 A * 7/1990 La Pierre ..... 15/257.06
5,139,139 A * 8/1992 Goetz ..... 15/257.06
5,533,228 A * 7/1996 Jarecki et al. ..... 15/257.06
5,713,095 A * 2/1998 Wakat ..... 15/230.11
5,956,802 A * 9/1999 Wakat et al. ..... 15/257.05
5,966,772 A * 10/1999 Woodnorth et al. ..... 15/230.11
6,101,658 A * 8/2000 Shehow et al. ..... 15/257.05

FOREIGN PATENT DOCUMENTS

DE 1035022 * 7/1958 ..... 15/257.06

* cited by examiner

*Primary Examiner*—Gary K. Graham
(74) *Attorney, Agent, or Firm*—Jacobson & Johnson

(57) ABSTRACT

A decorative painting kit including multiple-color paint applicators and a method of decoratively painting a surface though in situ surface blending of two or more paints of different colors by using a multiple-color paint applicator which is stroked over the same surface a sufficient number of time to at least partially blend the different paint colors. The partial in situ surface blending of two or more paints produces a decorative pattern on the painted surface that is color characterized by having areas with some of the original paint colors and other areas with various blends of the original paint colors thereon to produce a decoratively painted surface.

4 Claims, 7 Drawing Sheets

PAINT SYSTEM

CROSS REFERENCE TO RELATED APPLICATIONS

This application claims benefit of U.S. provisional patent application titled Paint Systems, Ser. No. 60/096,423, filed Aug. 13, 1998.

FIELD OF THE INVENTION

This invention relates generally to decorative painting and, more specifically, a decorator paint kit having multiple-color paint applicators and a decorative pad painting method that is capable of simultaneously applying different colored paints with a single sweep of the paint applicator so that overlapped stroking with the paint pad applicator can in situ surface blend the different colored paints to produce a decorative pattern.

BACKGROUND OF THE INVENTION

The concept of decorative pattern painting by using sponges and other applicators to apply paint in various patterns is known in the art. Typically, sponges are used to daub paint on to a surface to produce a decorative pattern. Another method involve the use of a double roller with raised patterns on the roller to form decorative paint patterns as the double roller is rolled over the surface. The application of two different colored paints with two side by side rollers involves applying layers of paint on top of one another as the rollers are rolled over the surface. Another method use a plastic bag over the roller to apply a decorative surface finish to the painted surface by rolling the roller with the bag thereon over a painted surface to obtain a decorative pattern . Other methods of decorative painting use color washing, stippling or applying splotches of paint to a surface that are then spread with a brush.

A feature of the present invention is the use of a paint pad applicator which carries multiple color paints in an unmixed side by side relationship. The applicator is stroked or moved laterally along a surface to form a color blended decorative pattern thereon. The decorative pattern is determined on the amount of in situ blending of the different paint colors as well as the type of strokes used to apply the paints. After stroking an area, the paint pad applicator is again loaded with fresh paints so that the paint pad applicator again carries multiple color paints in an unmixed and side by side relationship. This method involves the continual refreshing of the paint pad applicator with the original color paint which are in an unmixed state on the paint pad applicator. I call my method of painting PADBRUSHING™. In contrast to the rolling of two different color paints on a surface the stroking of the paint pad applicator provides an in situ blending of the paint colors on the surface resulting in a decorative color pattern as the paint pad applicator mixes the paint as the pad is pulled or pushed over the paint on the surface. In addition by varying the strokes and by daubing either end of the three color paint pad applicator one can also obtain a decorative stroke pattern in conjunction with the decorative color pattern.

In an alternate decorative method that does not involve PADBRUSHING™ a paint roller applicator carrying three or more paint colors on separate rollers which are used to simultaneously apply three or more color paints to surface. The use of three or more colors in a paint roller with a non-decorative pattern on the paint roller provides decorative tracks or band of the three different paints on the surface. By rolling over the bands of the different paints multiple times one can produce a decorative surface. While the decorative multiple paint rollers generally lacks the in situ blending that can be achieved using my PADBRUSHING™ method of applying paint to a surface, the use of three different colors with three or more rollers one can provide a layering and mixing effect to produce a decorative pattern which is a function of the amount of rolling of the surface and not a function of a decorative pattern on the roller.

BRIEF DESCRIPTION OF THE PRIOR ART

U.S. Pat. No. 2,813,292 shows a paint applicator for painting poles and the like.

U.S. Pat. No. 3,358,312 shows a paint applicator for painting posts.

U.S. Pat. No. 3,562,837 shows a dual-headed paint roller with a detachable handle system.

U.S. Pat. No. 3,649,986 shows a dual-headed paint applicator with heads positioned at different angles to create a "bristling" action.

U.S. Pat. No. 3,714,674 shows a roller paint applicator for painting curved and irregular surfaces.

U.S. Pat. No. 4,164,299 shows a tray for hand-held paints and brushes.

U.S. Pat. No. 4,320,553 shows a multiple roller system that utilizes parallel rollers to prevent paint from splattering.

U.S. Pat. No. 4,335,484 shows a paint roller for painting fence pickets.

U.S. Pat. No. 4,644,604 shows a paint applicator for painting iron railings.

U.S. Pat. No. 5,035,022 shows a paint applicator for use in tri-planar applications.

U.S. Pat. No. 5,269,039 shows a paint roller assembly of varying length.

U.S. Pat. No. 5,713,095 shows a bifurcated pan and paint roller which utilizes an independent shaft to support each roller.

BRIEF DESCRIPTION OF THE INVENTION

The present invention provides a decorator painting kit having multiple-color paint applicators and a method of decoratively painting a surface though in situ surface blending of two or more paints of different colors by using a multiple-color paint applicator which is stroked over the same surface a sufficient number of times to at least partially blend the different paints to produce a color decorative paint surface. The partial in situ surface blending of multiple paints of different colors with a single paint pad applicator produces a decorative painted surface that is color characterized by the amount of stroking of the paint pad applicator and the frequency of which the paint pad applicator is reloaded with the multiple colored paints. The amount of stroking can determine the final color or colors of the surface and if a limited amount of stroking is used in some cases some areas will have the original paint colors and other areas will have various blends of the original paint colors thereon. If stroking is continued for a longer period one can produce a decorative painted surface that is a blend of all three colors; however, to obtain the desired decorative pattern of the present invention it is desired to only partially in situ blend the different color paints.

DESCRIPTION OF THE INVENTION

Figure 1:
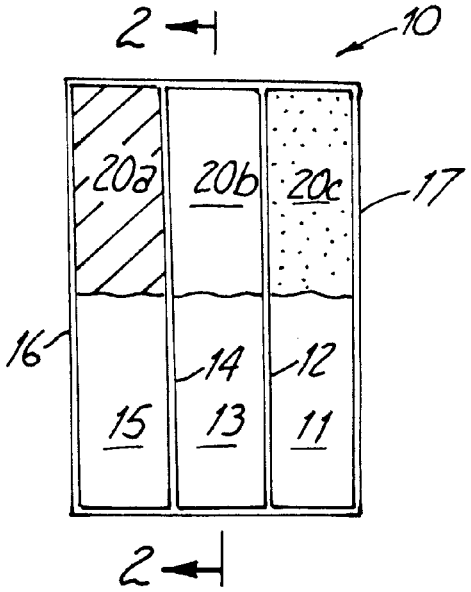
FIG. 1 is a top view of a paint tray having multiple compartments for simultaneously holding different colored paints.

FIG. 1 shows a top view of a paint roller tray 10 with the paint tray having side walls 16 and 17 and longitudinal dividers 12 and 14 which divide the paint tray into three elongated compartments 11, 13, and 15, each having a different colored paint therein. That is, a paint 20*a* of a first color is located in compartment 15, a paint 20*b* of a second color is located in compartment 13 and a paint 20*c* of a third color is located in compartment 11. Thus paint roller tray 10 can maintain three different color paints in isolation from each other. In this embodiment the paint roller tray 10 can be used to supply three different colored paints to a paint roller having three different paint rollers located in axial alignment with each other and spaced from each other. With modifications described hereinafter the paint tray 10 can be used with my PADBRUSHING™ method to insitu blend paint on a surface. However, the option exists for a user to use the paint tray 10 in conjunction with a three part roller to simultaneously apply three different color paints to a surface. Although the application of paint with three rollers does not produce the same decorative pattern as my PADBRUSHING™ method some people may like the option of being able to roll on three different colors onto a surface using a three part roller that does not have a nap of the roller containing a decorative pattern thereon.

Figure 2:
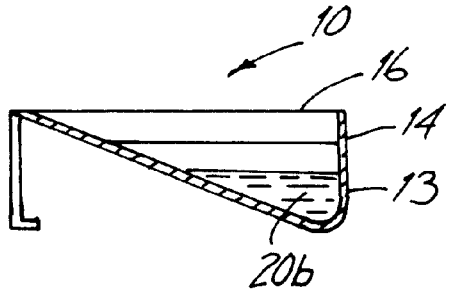
FIG. 2 is a cross sectional view taking along lines 2—2 of FIG. 1.

FIG. 2 shows a cross-sectional view of the paint tray 10 taken along lines 2—2 indicating that compartment 13 contains paint 20*b* therein. Similarly, each of the other compartments contain a different colored paint.

Figure 3:
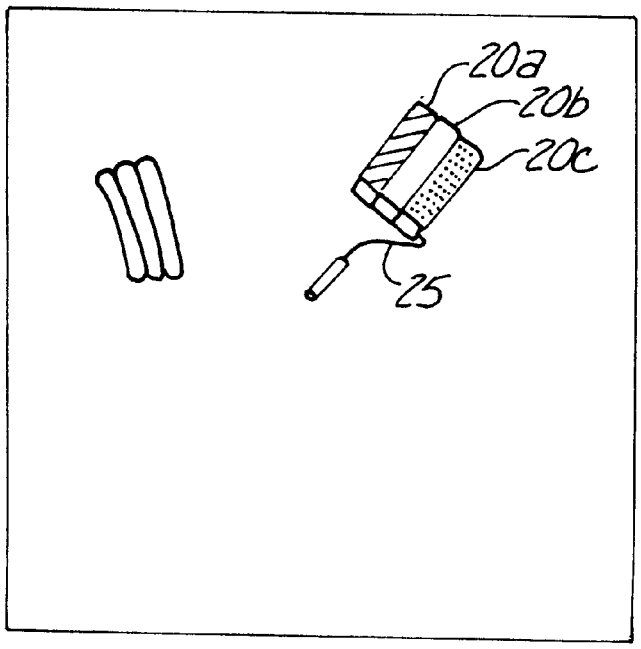
FIG. 3 is a view of a wall with a segmented paint roller with positionable segmented rollers in a position for simultaneously applying bands of different colored paint to a wall.

FIG. 3 shows a three segmented paint roller 25 that can be used to roll paint on a surface when the paint tray 10 is used. That is, by having multiple rollers on a single axis, one can simultaneous apply three different paint colors to a surface. FIG. 3 illustrates paint roller 25 simultaneously applying three bands of different colored paints 20*a*, 20*b* and 20*c* to the wall surface. The bands of different colors are created by rolling the paint roller along an axis generally perpendicular to the axis or rotation of the segmented paint roller 25. That is, if the segmented paint roller is moved laterally, it would smear the different colored paints 20*a*, 20*b* and 20*c* onto one another; however, with a sweeping motion. The segmented paint roller can simultaneously apply three bands of different colored paints to a surface by rolling the paint onto the surface.

Figure 4:
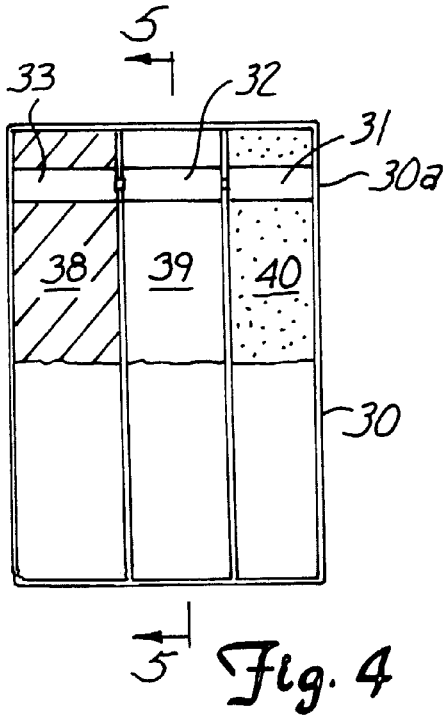
FIG. 4 shows a top view of paint tray having multiple compartments with separate paint transfer rollers extending partially into the paint in the paint tray.

FIG. 4 shows a top view of the multi-compartment paint tray 30 for use with the preferred method. Multi-compartment paint tray 30 is similarly to paint tray 10 but includes a paint dispenser which comprises a set of three paint transfer rollers 31, 32, and 33 thereon for transferring three different color paints from paint tray 30 to a paint pad. Paint transfer rollers extend partially into the paint in the respective compartments and are rollably mounted on a common axis 30*a* which is supported by tray 30 to permit rotation of rollers 31, 32 and 33.

Figure 5:
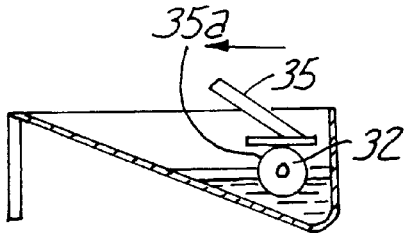
FIG. 5 is a cross-sectional view taken along lines 5—5 of FIG. 4 showing one of the paint transfer rollers extending into the paint in the compartment and a paint pad being pulled across the paint transfer roller to cover the paint pad with bands of different colored paint.

FIG. 5 shows a sectional view taken along lines 5—5 to show a paint pad 35 being moved tangentially across rollers 32 to cause the roller to load paint 20*b* onto the pad surface 35*a* which comprises a nap of uniform height. Similarly, the paint pad 35 is being simultaneously moved across paint transfer rollers 31, 32 and 33 to apply bands of different colored paint to the surface of paint pad 35.

Figure 6:
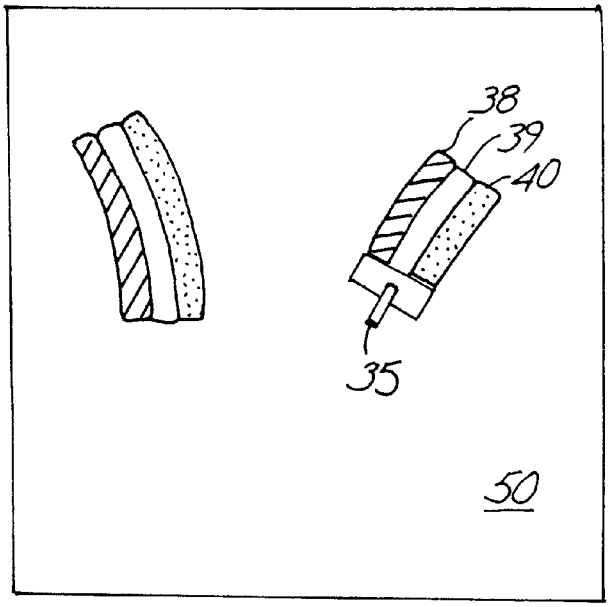
FIG. 6 shows the paint pad being pulled across a surface to simultaneously apply bands of different wet colored paint to a wall surface.
Figure 7:
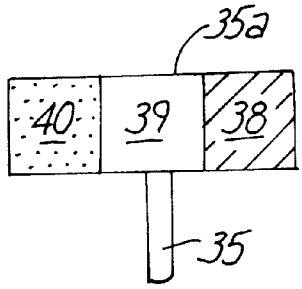
FIG. 7 shows the underside of a paint pad with different color paints thereon.

FIG. 7 shows the underside of paint pad 35 with three different colored paints 38, 39 and 40 located on the surface 35*a* of paint pad 35. This type of arrangement of paint colors on the paint pad applicator can be obtained if the paint transfer rollers are placed in close end to end proximity to each other in the paint tray which resulting in three bands of paint 38, 39 and 40 located in a side by side relationship and in close proximity to an adjacent color paint. By pulling the paint pad in the axial direction indicated by the arrow, three individual paint colors can be applied to a surface in band form as shown in FIG. 6.

FIG. 6 shows the paint pad 35 being pulled across a surface to simultaneously apply bands 38, 39, and 40 of different colored paints to wall surface 50. Thus unlike a conventional paint pad applicator, which has a single paint thereon, the present invention is loaded with multiple paints and allows one to apply bands of one, two, or more different paint colors to wall surface 50. The simultaneous application of multiple bands of paint with the same paint pad applicator produces an in situ blending effect not found with rollers or other methods.

A paint method for decorative painting a surface using the paint pad applicator 35 includes the step of applying at least two different colored paints to adjacent areas on a paint pad applicator to provide side by side bands of colored paint on the paint pad applicator. Next, the user places the paint pad applicator on a surface and moves the paint pad applicator in a line generally parallel to the bands of paint on the pad to produce bands of different colored paint on the surface. The user can refresh the paint pad applicator with the at least two different colored paints by pulling the paint pad applicator across the paint transfer rollers to load fresh paint onto the paint pad. With the paint pad applicator refreshed the user moves the refreshed paint pad applicator across the bands of different colored paint on the surface to in situ blend the paint from the refreshed paint pad applicator with the previously applied bands of colored paint on the surface to produce a decorative painted surface.

Figure 8:
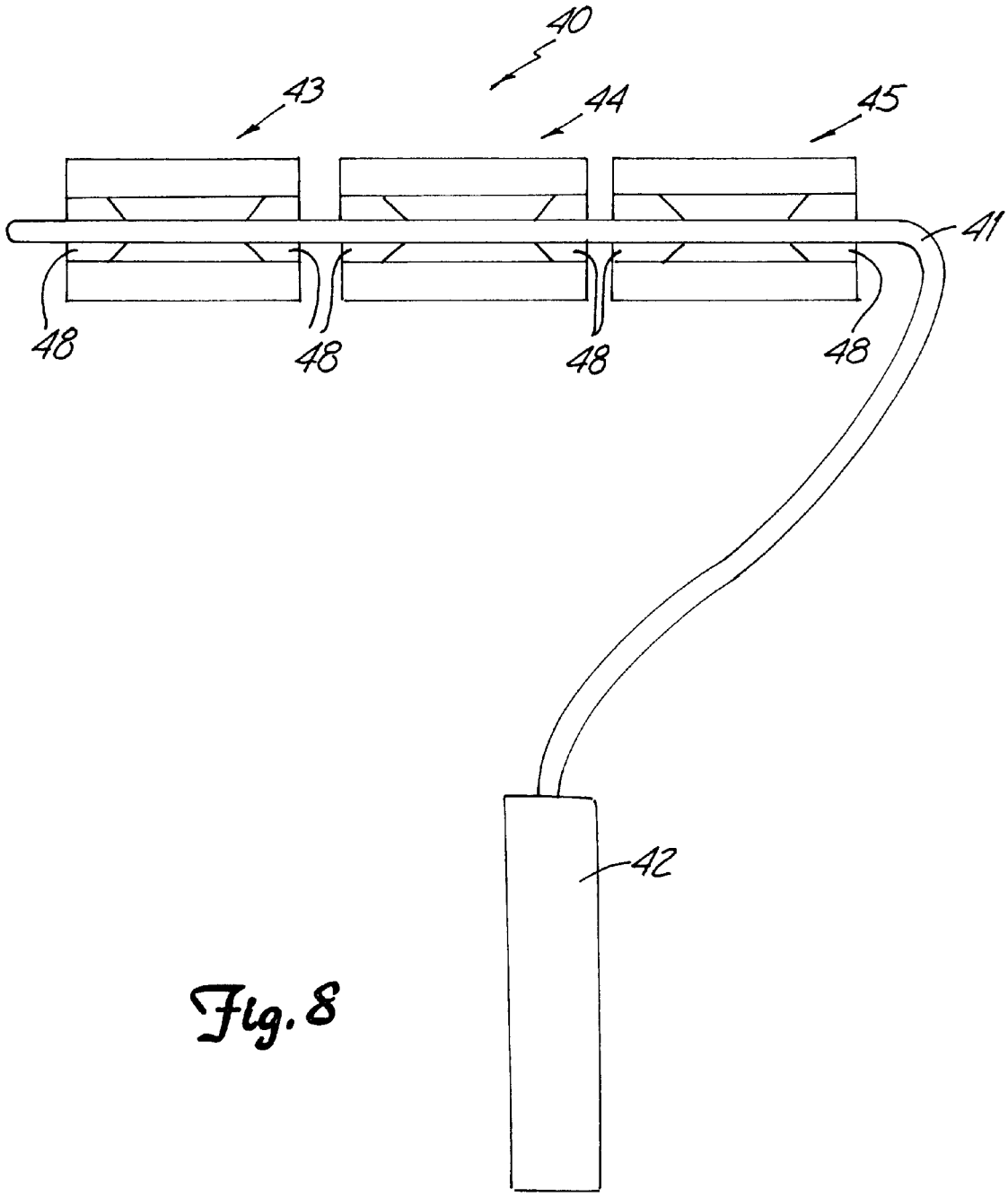
FIG. 8 shows a cross-sectional view of a segmented paint roller with laterally positionable paint rollers thereon.

FIG. 8 shows a cross-sectional view of a three segmented paint roller 40 having a single shaft 41 that connects to handle 42 with the terminal portion of shaft 41 having a straight section for gripping three segmented rollers 43, 44, and 45 thereon. Each of the rollers contain an internal friction mount 48 that grips the shaft 41 to prevent slippage of the segmented roller along the axis of the shaft. The internal friction mount incudes a bearing therein so the rollers can rotate freely. The use of multiple friction mounts with segmented rollers allows the user to use multiple rollers as well as to space the multiple rollers to whatever distance is desired. If the user wants to make bands of color that are spaced apart from each other, the user can slide the segmented rollers further apart. Similarly, if one wants the bands of paint closer together, one can slide the segmented rollers toward each other. Thus, the use of friction mounts with multiple segmented rollers provides a method of varying the pattern without having to change the applicator. Similarly, if the operator wanted to use only two rollers one can be quickly removed by sliding the roller off of the shaft.

Figure 8A:
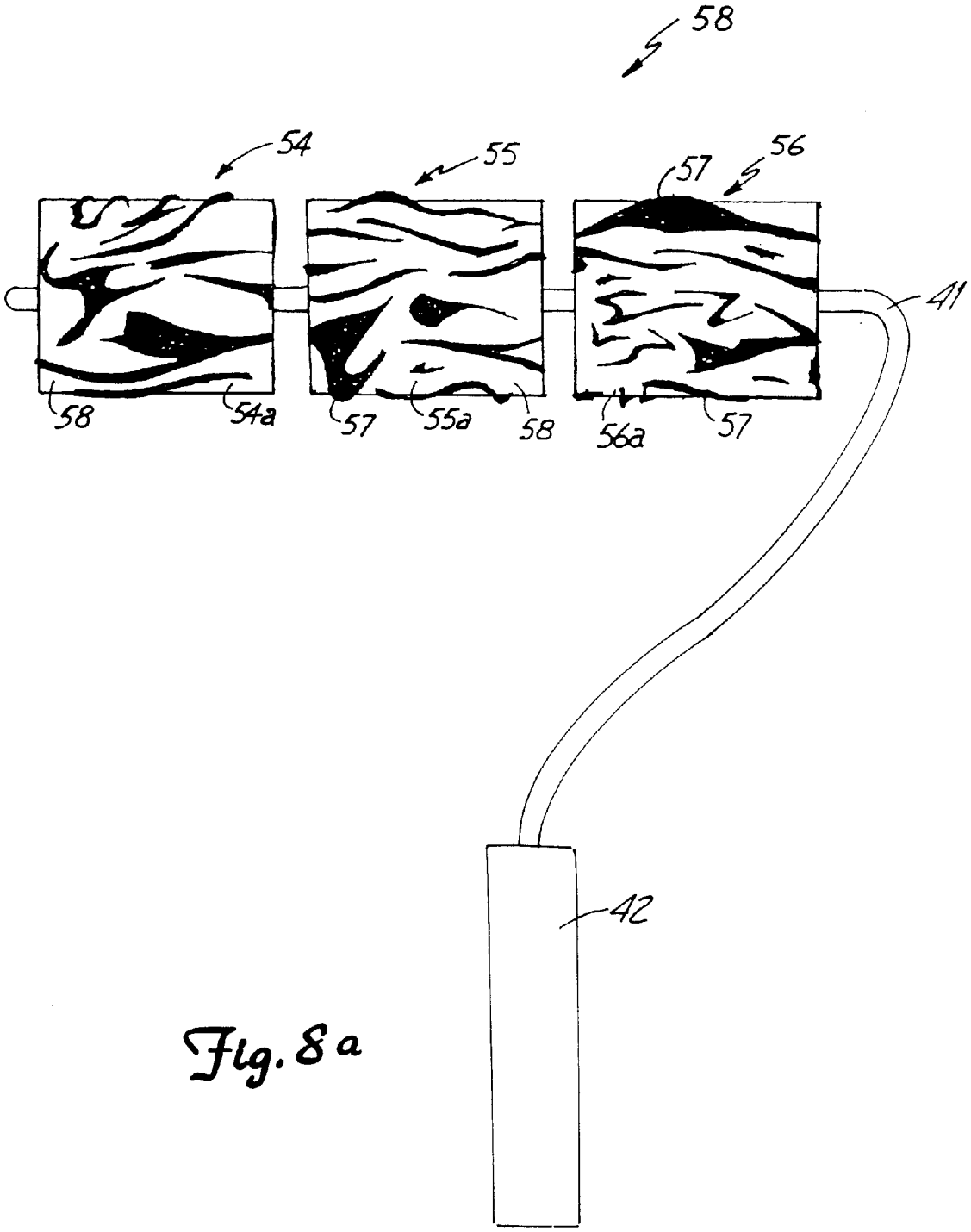
FIG. 8*a* shows a front view of a segmented paint roller with laterally positionable paint rollers thereon, the paint rollers covered in a ragging material.

FIG. 8*a* shows a three segmented paint roller 59 that is similar to the paint roller of FIG. 8. The paint roller 59 has a single shaft 41 that connects to a handle 42 with the terminal portion of shaft 41 having a straight section for gripping three segmented rollers 54, 55, and 56 thereon. The rollers 54, 55 and 56 are attached to the shaft 41 in the same manner described in the description of FIG. 8 for rollers 43, 44, and 45. Similarly, the rollers may be compressed towards one another or spaced apart farther, or one or two of the rollers may be removed from the shaft completely to allow a user to discern the proximity and number of paint rollers on the shaft 41. Paint roller 59 includes a shaft extending from handle 42 and terminating in a straight shaft section 41 which is substantially perpendicular to an axis through handle 42. A first roller 56 is rotatably mounted on shaft 41, with the first roller having a loose fitting roller cover 56*a* thereon. A second roller 55 is rotatably mounted on shaft 41 and has a loose fitting roller cover 55*a* thereon with the second roller 55 axially spaced from first roller 56 so as to form a gap therebetween. Similarly, a third roller 54 is rotatably mounted on shaft 41 with the third roller having a loose fitting roller cover 54*a* thereon and being axially spaced from second roller 55 so as to form a gap therebetween so that when each of rollers 54, 55, and 56 are loaded with a different color paint the simultaneous rolling of the three rollers across a surface produces both a multicolored pattern from the different color paints and a decorative pattern from the uneven application of paint from the roller covers that have creases and folds thereon.

In the embodiment shown in FIG. 8*a* the rollers are covered with an absorbent "ragging" or bag like material that forms a loose fitting roller cover that can be used to absorb paint from a paint tray. The roller cover or bag roller is known in the art and generally has excess material that surrounds the roller in the form of crease and folds. However, in the present invention each of the individual rollers 54, 55, and 56 has a separate bag roller. The results is that when one rolls the multiple bag roller across a surface with different colored paints one produces both a multicolored pattern and a color texture pattern. When the paint roller 59 is placed into the paint pan, the bag rollers collect paint and when rolled across a surface the raised portions or folds 57 apply more paint to a surface while the sections 58 between folds provide less paint to the surface. When the paint roller with the three separate rollers is used on a surface to be painted, the raised portions 57 of the paint roller 59 apply paint in a unique "ragging" pattern that creates an aesthetically pleasing effect As the bag surrounding the roller is loose fitting the individual pattern will vary from roller to roller, as the covering on each of the rollers is slightly loose, and therefor changeable.

It should be pointed out that the pattern obtained by using three rollers differs considerably as opposed to a paint pad applicator with multiple color paints thereon. The multiple paint roller design tends to leave defined bands of paint on the wall surface with distinct edges between each band. In contrast, the use of the paint pad applicator with the multiple color paints thereon leaves a smother edge that feathers into the adjacent color paint. In addition the stroking of the painting pad applicator produces a lateral motion of the paint over the wall surface causing the in situ blending of the paints to produce a decorative effect based on the amount stroking and the frequency of loading the paint pad applicator with fresh paint. On the other hand the use of the multiple paint rollers produces a band effect with the bands of paint overlaid each other. That is, a roller tends to transfer paint radially outward of the roller as the roller moves along the surface whereas the paint pad applicator moves the paint laterally along the wall surface. While each has its application the in situ blending of multiple color paints on a surface using a paint pad applicator is the process I refers to as a PADBRUSHING™ method.

Figure 9:
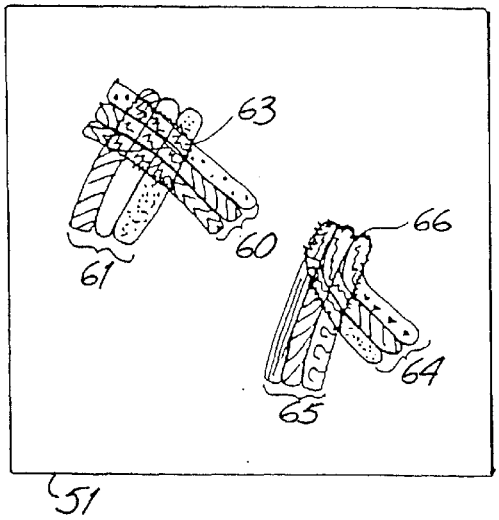
FIG. 9 shows a surface which has been partially painted with a multi-color paint applicator.
Figure 10:
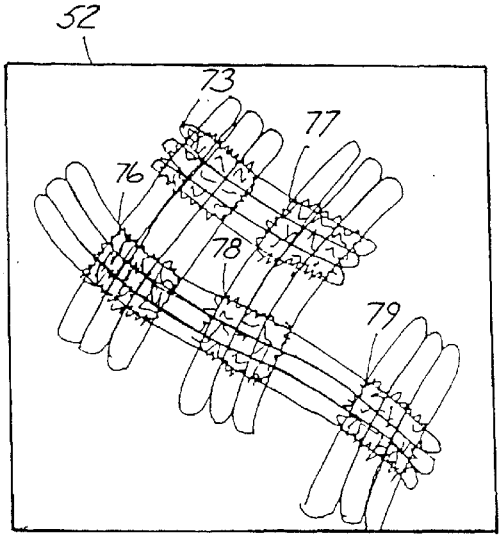
FIG. 10 shows a surface which has been in situ surface blended with a multi-color paint applicator to produce a decorative pattern of multiple hues.
Figure 11:
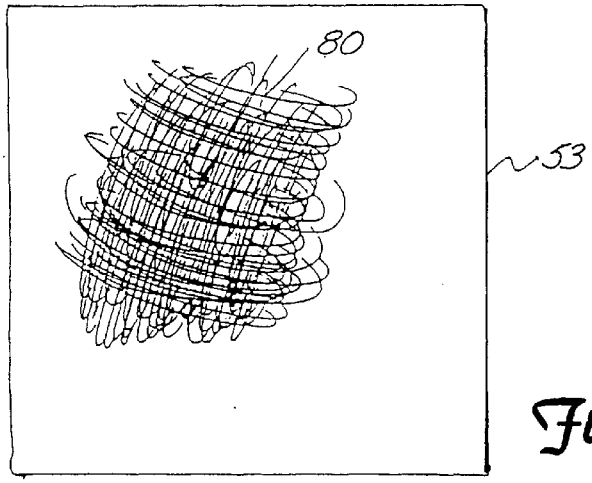
FIG. 11 shows a surface of substantially the same color where the multiple-color paints have been in situ blended into a single color.

FIGS. 9–11 illustrates the in situ paint blending method of the present invention with FIG. 9 illustrating use of a few stokes to provide regional in situ paint blending, FIG. 10 illustrating using more strokes to provide further in situ blending method to produce a decorative pattern and FIG. 11 illustrating using multiple strokes to in effect produce in situ over blending that produces a single color. In practice, one usually prefers to produce an in situ blending of the multiple color paints which is something between the decorative pattern illustrated in FIG. 10 and the decorative blend illustrated in FIG. 11. That is, FIG. 9 shows a surface 51 with multiple strips of three distinct bands of paint applied thereto with partially overlap in selected areas. A first strip of three different bands of paints is identified by numeral 60 and a second strip of three different bands of paint is identified by numeral 61. The region of overlap is defined by reference numeral 63. Similarly, a third strip of three different bands of paints is identified by numeral 65 and a fourth strip of three different bands of paint is identified by numeral 64. The region of overlap is defined by reference numeral 66.

With the method of the present invention, one provides a decorative painted surface though in situ surface blending of two or more paints of different colors by using a multi-color paint applicator which is stroked over the same surface a sufficient number of times to partially blend the different paints in certain regions. The partial in situ surface blending of two or more paints produces a decorative painted surface that is color characterized by having regions or areas with some of the original paint colors and other areas 63 & 66 with various blends of the original paint colors thereon to produce a decoratively painted surface. The decorative surface illustrated by the painting shown in FIG. 3 is a minimum type decorative pattern and for most purposes lacks the esthetic appeal, of the in situ surface blending illustrated in FIG. 10 which shows regions 73, 76, 77, 78 and 79 which are surface blended by multiple strokes to provide a set of decorative regions thereon.

FIG. 11 illustrates the over surface blending condition when the user strokes the paint applicator with the multiple colors to produce a single region 80 of the same color. That is, the present method of decorative painting comprises stroking the applicator with different color paints on a surface with sufficient strokes to in situ surface blend the multiple paints in selected regions but not with sufficient strokes so as to completely surface blend the multiple paints into a single color. Consequently, based on the tastes of the applicator the decorative pattern can be made bold to show the multiple color paints or the decorative pattern can be an in situ blended paint surface with the degree and amount of in situ blending from place to place on the surface. The result is a soft blend that the user can achieve.

Figure 12:
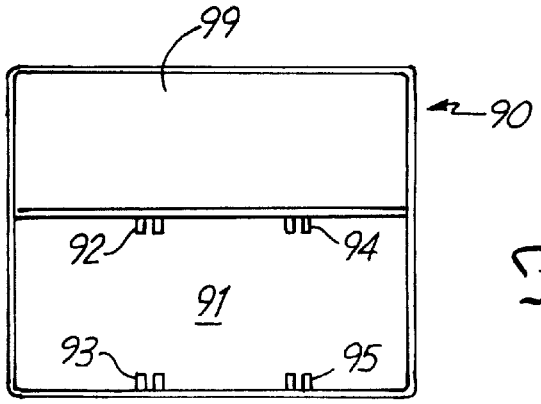
FIG. 12 is a top view of a convertible paint pad tray for use in loading one or multiple color paints onto a pad brush with the paint pad tray shown in the mode for applying a single color paint to a paint pad.

FIG. 12 is a top view of a convertible paint tray 90 for use in loading one or multiple color paints onto a pad brush with the paint tray having a paint compartment 91 and a shelf area 99. The paint tray is shown in the mode for applying a single color paint to a paint pad, that is there is only one compartment 91 for holding paint thereon. Paint tray 90 contains members 92 and 93 that project from opposite sides of compartment 91 to receive dividers.

Figure 13:
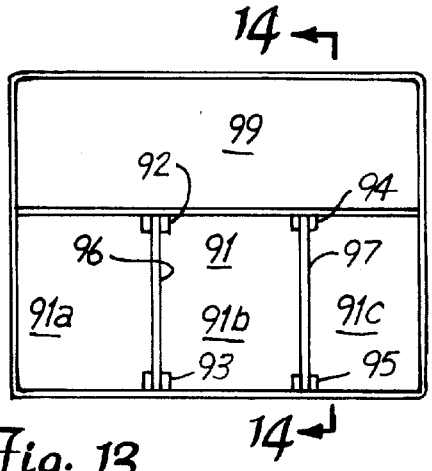
FIG. 13 is a top view of a convertible paint tray of FIG. 12 with the paint tray shown in the mode for applying three different color paint to a paint pad.

FIG. 13 is a top view of the convertible paint tray of FIG. 12 with the paint tray shown in the mode for accepting a three color paint transfer roller for applying three different color paints to a pad brush. In this mode, paint tray 90 contains members 92 and 93 that project from opposite sides of compartment 91 to receive a first divider 97 and members 94 and 95 that project from opposite sides of compartment 91 to receive a second divider 96 to form compartment 91 into there compartments 91*a*, 91*b* and 91*c*. In this mode a pad brush can be loaded with paint.

Figure 14:
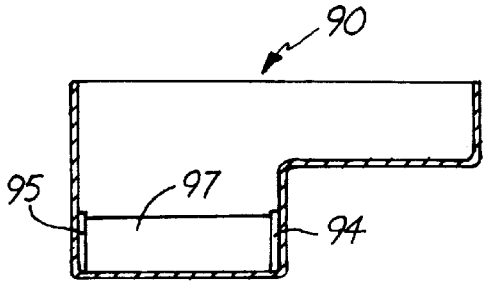
FIG. 14 is a side view of a convertible paint tray of FIG. 13 taken along lines 14—14.

FIG. 14 is a side view of a convertible paint tray of FIG. 13 taken along lines 14—14 to show how divider 97 sets within members 94 and 95 to isolate the paint containers compartment 91 into multiple paint compartments.

Figure 15:
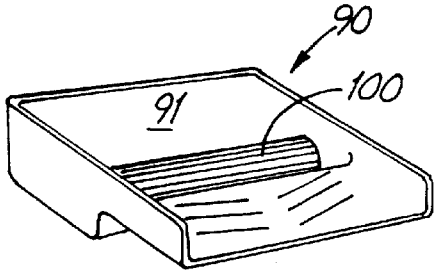
FIG. 15 is a perspective view of a convertible paint tray of FIG. 12 with the paint tray shown in the mode for applying a single color paint to a paint roller.

FIG. 15 is a perspective view of a convertible paint tray of FIG. 12 with the paint tray shown in the known mode for applying a single color paint to a paint pad. That is convertible paint tray 90 includes a single cylindrical applicator 100 that is rotationally supported and extends partially into the paint compartment 91 to allow a single color paint to be rolled onto the paint pad applicator.

Figure 16:
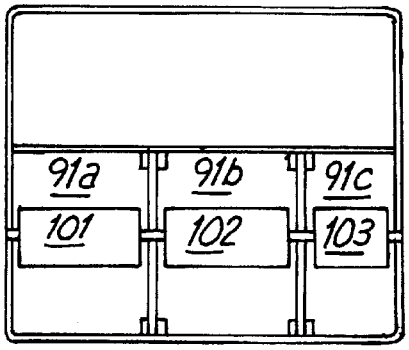
FIG. 16 is a top view of a convertible paint tray of FIG. 12 with the paint tray shown in the mode for applying three different color paint to a paint pad applicator.

FIG. 16 is a top view of a convertible paint tray 90 of FIG. 12 with the paint tray shown in the mode for applying three different color paints to a pad brush applicator. That is convertible paint tray 90 includes three segmented cylindrical transfer rollers 101, 102 and 103 which are located respectively in compartments 91*a*, 91*b* and 91*c*. With this embodiment one can simultaneously apply at least three different color paints to a paint pad applicator by pulling the pad across the rollers as illustrated in FIG. 5.

Figure 17:
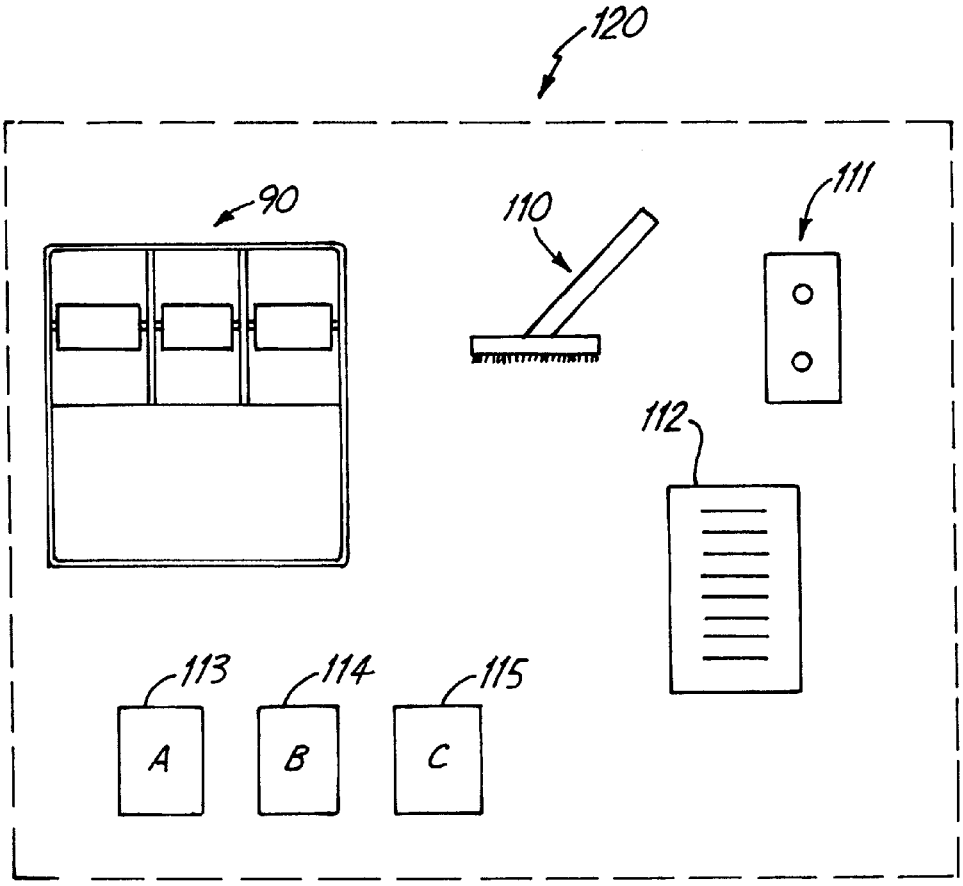
FIG. 17 shows a decorative painting kit for decorative painting.

FIG. 17 shows a decorator painting kit 120 for decorative painting using my PADBRUSHING™ method. The kit can be used for fast, easy faux finish special effects painting in three colors with the multiple colors applied simultaneously to a surface that has a base coat of a different color. The decorator painting kit includes a convertible paint tray 90*a*, a paint pad applicator 110 having a width substantially equal to the width of the paint tray 90 but slightly less to accommodate the paint pad applicator therein. Preferably, paint pad has a width of about 10 inches and the tray has a dimension of about 12 inches. With the above dimension one can simultaneously load three different bands of paint in three inch bands onto the paint pad applicator. Three different color paints 113, 114 and 115 are included so that the consumer can select one, two or three different paints to use in the convertible paint tray 90. In order for the consumer to pursue decorative painting with my invention I offer instructions in the form of a video cassette 111 and an instruction sheet 112. Video cassette 111 shows the purchaser how to in situ blend the paint on a surface. Instruction sheet 112 shows and decries how one can in situ blend the paint on a surface. While both video cassette 111 and instruction sheet 112 are shown in most cases only one type of instruction is needed. By using the kit 120 a user can quickly begin decorative painting by in situ blending of different colored paints and by using the video or instruction sheet the user can quickly pick up techniques to provide a professional look to the finished surface.

Thus with the present invention one obtains a method of decorative painting using in situ surface blending that generally involves placing a base coat of paint on a surface. After applying the base surface one can simultaneously apply at least two different colored paints to a paint pad applicator. With the paint pad applicator loaded with at least two different color paints one stroking the paint pad applicator on a surface to produce a strip having different colored bands of paint. Before the paint dries one continues to stroke the paint pad applicator across the strip of the different colored bands of paint a sufficient number times to in situ surface blend at least two different colored paints to produce regions of blended colors. By limiting the amount of stroking one can avoid the excessive stroking that would in situ blend the at least two different colored paints into a surface of a single blended color.

What is claimed is:

1. A painting kit for decoratively applying multiple color paints with a single applicator tool before any of the multiple color paints have dried comprising:

a paint tray, said tray having a shallow end and a reservoir end, said tray including at least two dividers for dividing said paint tray into elongated compartments with each of the compartments holding a liquid paint that is a different color from at least one of the other paints in an adjacent compartment;

a pair of support members mounted on opposite sides of said paint tray;

a paint dispenser of a first width, said dispenser rotatably mounted from said support members with said dispenser comprising at least three separate paint transfer rollers with each of said rollers extending at least partially into the reservoir end of the paint tray so that each of the separate paint rollers can pick up paint from it's respective compartments as the paint roller is rotated about a central axis;

a paint pad applicator, said paint pad applicator having a width substantially equal to the width of the dispenser so that when the paint pad is frictionally engaged with the roller, the paint pad rotates the roller to transfer at least two different colored paints to the paint pad to thereby create a single paint pad with adjacent regions containing different colored paints so that the paint pad can then be wiped against a surface to deliver a surface pattern with multiple colors.

2. A paint kit for decorative color painting including:

a segmented paint applicator comprising:

a handle;

a shaft extending from said handle and terminating in a section which is substantially perpendicular to an axis through said handle;

a first friction mount roller for mounting on the shaft;

a second friction mount roller for mounting on the shaft and a third friction mount roller for mounting on the shaft with each of the friction mount rollers spaceable from each other by sliding said friction mount rollers along the shaft to enable a user to alter the number of bands of colored paint applied from the segmented roller as well the spacing between the bands of colored paint applied from the segmented roller; and instructions for in situ decorative painting to enable a person to use the segmented applicator to in situ surface blend a paint applied by each of the friction mount rollers.

3. A paint kit for decorative color painting comprising:

a paint pad applicator having a handle and a flat pad for absorbing paint therein;

a paint tray for holding at least two different colored paints, said paint tray having at least two compartments with each compartments having an applicator to provide for simultaneously loading of the at least two different colored paints onto said paint pad applicator, said applicator in each of the compartments comprising a roller partially immersed in the paint in the compartment;

a first paint of a first color;

a second paint of a second color with the second color being different from the first color; and instructions for in situ decorative painting to enable a person to use the paint pad applicator to in situ surface blend the first paint of a first color with the second paint of a second color.

4. A paint kit for decorative color painting comprising:

a paint pad applicator having a handle and a flat pad for absorbing paint therein;

a paint tray for holding at least two different colored paints, said paint tray having at least two compartments with each compartments having an applicator to provide for simultaneously loading of the at least two different colored paints onto said paint pad applicator, said applicator in each of the compartments comprising a roller partially immersed in the paint in the compartment;

a first paint of a first color; and a second paint of a second color with the second color being different from the first color to enable a person to in situ surface blend the first paint of a first color with the second paint of a second color.

* * * * *